United States Patent [19]

Clough

[11] Patent Number: 4,915,004

[45] **Date of Patent: * Apr. 10, 1990**

[54] BODY FOR AN ELECTRONIC STRINGED INSTRUMENT

[75] Inventor: Eric Clough, Berkley, Mich.

[73] Assignee: EMC2, Inc., Akron, Ohio

[ * ] Notice: The portion of the term of this patent subsequent to Apr. 10, 2007 has been disclaimed.

[21] Appl. No.: 215,218

[22] Filed: Jul. 5, 1988

[51] Int. Cl.[4] ..... G10D 3/00; G10D 1/08; G10H 3/00

[52] U.S. Cl. ..... 84/291; 84/292; 84/723; 84/267

[58] Field of Search ..... 84/1.16, 291, 292, 1.15, 84/1.14, 1.01, 293, 267, 723, 726, 731

[56] References Cited

U.S. PATENT DOCUMENTS

| | | | |
|---|---|---|---|
| 3,771,408 | 11/1973 | Wright | 84/1.16 X |
| 4,213,370 | 7/1980 | Jones | 84/291 |
| 4,295,403 | 10/1981 | Harris | 84/293 |
| 4,432,267 | 2/1984 | Feller | 84/291 X |

OTHER PUBLICATIONS

G. B. Herzog, "Transistorized Ukulele", Radio—Electronics, Feb. 1954, pp. 30–32.

*Guitar Player,* Dec., 1987, pp. 50–88, 169.

*Primary Examiner*—A. T. Grimley

*Assistant Examiner*—Matthew S. Smith

*Attorney, Agent, or Firm*—Buchanan Ingersoll

[57] ABSTRACT

A body for an electronic stringed instrument is disclosed in which an inner metal chassis is provided with a removable and replaceable outer body shell. The chassis has a first end adapted to receive and secure a neck of a guitar or similar instrument and an opposite end adapted to receive and secure a bridge. The chassis has at least one opening in its upper surface adapted to receive and secure an electric pickup. The body of the outer shell includes a lower portion which is removably secured to the metal chassis and an upper portion which is removably secured to the lower portion. The outer shell creates a cavity into which various electronic components may be secured. Because the outer shell is removable, various outer shell shapes may be secured to a single chassis. Additionally, the metal chassis of the present invention provides superior resonance qualities over conventional solid wooden body guitars.

11 Claims, 3 Drawing Sheets

BODY FOR AN ELECTRONIC STRINGED INSTRUMENT

BACKGROUND OF THE INVENTION

1. Field of the Invention

The present invention relates to a body for an electronic stringed instrument. More specifically, the present invention relates to a body for an electric guitar having an inner metal chassis around which a removable outer body shell is secured.

2. Description of the Prior Art

Electric guitars have been known at least as early as the late thirties. At that time, conventional wooden acoustic guitars were provided with magnetic pickups under the strings. When an electric guitar is strummed, the vibration of the steel strings within the magnetic field of the pickups causes an electrical output which is sent to an amplifier for transduction to the room with the use of loud speakers. In approximately the late forties, solid body electric guitars were introduced. A solid wooden body replaced the hollow wooden box of the acoustic guitar. The solid body of the guitar was provided with small cavities sized to receive the pickups. The provision of a solid body electric guitar was made possible because the body of the guitar was no longer required to provide sufficient audio output. Rather, the movement of the strings within the magnetic field of the pickups was used to create an electronic output.

Except for the shape of solid body guitars and the fact that various manufacturers are today routing out larger cavities from the body of the guitar to receive signal processors and the like, solid body guitars have not changed significantly since their introduction.

Guitar strings are strung between a nut and a saddle. The nut is located at the very top of the neck. It has grooves filed into it through which the strings pass. These grooves secure the strings as they pass off the fretboard to the tuning machine heads. The nut has traditionally been made of ivory or hardwood. The intent in using some very hard material is to reduce the tendency for the nut to absorb vibration: the harder the material the more transmission of the vibrations to the neck. The seventies saw brass as the vogue material for nuts. Currently graphite is probably the favorite.

The saddle has, for electric guitars, been either hardwood or metal.

The big change in the seventies was to make the neck out of metal. The Travis Bean guitar took the concept to the logical limit of mounting a metal nut and saddle into a metal piece which passed from the saddle through the body neck creating an all metal chain of vibrating componentry. One end of each string is secured under the metal saddle in the metal body portion to the casting, it passes over a metal saddle and to a metal nut which is mounted into a metal neck. In effect, what is created is a metal bow (in a "bow and arrow" sense) with metal strings. The body of the guitar was superfluous to the structure or sound. The Travis Bean guitar is disliked because it is expensive, very heavy (20–25 lbs.), and requires a casting almost three feet long.

A middle ground was tried by Kramer. He bolted a metal neck to a standard solid wood body. It was supposed to provide the same attempt to increase sustain in a less costly, lighter format. The Kramer guitar is still heavy and it still requires a relatively large casting.

In addition to the main problem of an unacceptable increase in weight with the use of metal necks, such necks also have a tendency to become uncomfortable when they get cold. Still further, there is a tendency for the fretboard to separate from the neck given the differential in the coefficients of expansion and contraction between the metal of the neck and the wood of the fretboard.

In recent years, the technology relating to electric guitars has tended to relate the processing of the output of the pickups. Guitars based on synthesizers and microprocessor control of effects devices have now become commercially acceptable and, in some instances, are provided as bolt-on additions to the solid body electric.

Additionally, guitar synthesizers made entirely from plastics in a shape vaguely resembling a guitar are now commercially available. Most of these synthesizers, however, do not depend on tuned steel springs for output. Rather, they create sound in a manner similar to an electronic keyboard.

One manufacturer has replaced the wooden box of the traditional acoustic guitar by providing a parabolic plastic shell in place of wooden back and sides. This type of guitar is available with either a wooden or plastic top. As with traditional acoustic guitars, the strings terminate on the bridge located on the middle of the top sounding board of the guitar. Accordingly, with this type of guitar, the top of the body acts not only as a vibrating component, but also as a structural component. In this type of guitar, the pickups are in the form of crystals placed in the bridge.

There remains, therefore, a need for a body for an electronic stringed instrument which takes advantage of the superior resonant qualities of metal. There remains a further need for such a body which provides sufficient space for additional electronic components and which allows for the replacement of existing electronic components provided within the body.

Still further, there remains a need for a body for an electronic stringed instrument which allows for a replaceable outer body shell so that various outer shell shapes may be utilized on a single stringed instrument.

SUMMARY OF THE INVENTION

The present invention provides a body for an electronic stringed instrument. The body includes an inner metal chassis having a first end adapted to receive and secure a neck of the stringed instrument and an opposite end adapted to receive and secure a bridge of the stringed instrument. The chassis has at least one opening in an upper surface thereof adapted to receive and secure an electronic pickup. The body also includes a removable and replaceable outer body shell. The outer shell has a lower portion which is removably secured to the metal chassis and an upper portion which is removably secured to the lower portion. The outer shell creates a cavity into which various electronic components may be secured. The chassis of the present invention is preferably in the form of a U-shaped member having an upper surface portion and a pair of spaced-apart parallel side panel portions which depend downwardly from opposite side portions of the upper surface. The upper surface of the U-shaped chassis member also preferably includes a generally circular opening positioned at a location over which the strings of the instrument are strummed.

The cavity created within the body shell may readily accept an enormous variety of electronic devices. In addition to signal processors, the outer shell can house, for example, wireless transmitters, drum synthesizers, compact disc drives, tape recorders, or microprocessors. As new electronic devices are created this large cavity will become more and more important.

The body of the present invention may be molded into literally any shape. Various molding advances have greatly reduced the cost involved. For example, a R.I.M. molding process may be used to provide a body which has significant strength and durability in a wide variety of shapes. The body may be changed or enhanced on a periodic basis by the manufacturer without any changes to the chassis being required.

Because the outer body shell surrounds the electronics, it may be utilized as a shielding device by adding conductive materials to the plastic compound of the shell or by painting the interior of the shell with a conductant paint prior to assembly. This process helps eliminate hum and interference from fluorescent lights or passing CB radios, both of which are serious problems in on-stage situations in which the guitar may be played at very high sound pressure levels.

The chassis of the present invention is significantly more resonant than the solid body of wood which it replaces. The metal chassis contributes to greatly enhanced sustain properties and overall guitar resonance. None of the guitars of the prior art can provide comparable sustain and resonance properties. An additional advantage of the present invention is that it may be played "acoustically" without amplification and still produce sufficient volume for personal enjoyment. Solid body guitars of the prior art provide very little acoustic output.

It will be obvious to those skilled in the art that the acoustic characteristics of the chassis are dependent both upon the materials and the dimensions of the chassis. The malleability of this acoustic characteristic is an area of significant potential in the optimization of the present invention. It is contemplated that various computer models could be utilized to create and suggest suitable parameters for the chassis which will produce desired sonic characteristics.

An additional advantage of the provision of a metal chassis is that it provides an excellent ground connection. Because the entire outer body shell may become a component of this ground connection unwanted interference and hum may be eliminated.

The present invention also provides additional advantages to the guitar player. Such advantages include the fact that the chassis and outer shell are generally lighter than the solid body guitar which it replaces. This may be a significant factor for a working musician who must hold the guitar for several hours at a time during performances.

Another advantage of the present invention is that the body is entirely modular. The electronics, including the pickups, may be readily removed and replaced. This flexibility extends to the body shell and the neck as well. The entire look of the guitar can be easily changed simply by changing the body shell. The feel of the guitar can be changed by replacing the neck with one of a different material or of slightly different dimensions to fit the player's preference. Further, additional electronics and/or pickups can be easily fitted to the guitar by removing the shell, installing the additional items in the chassis, and replacing the shell.

These and other objects and advantages of the present invention will become more apparent upon reference to the following figures.

DETAILED DESCRIPTION OF THE PREFERRED EMBODIMENTS

Figure 1:
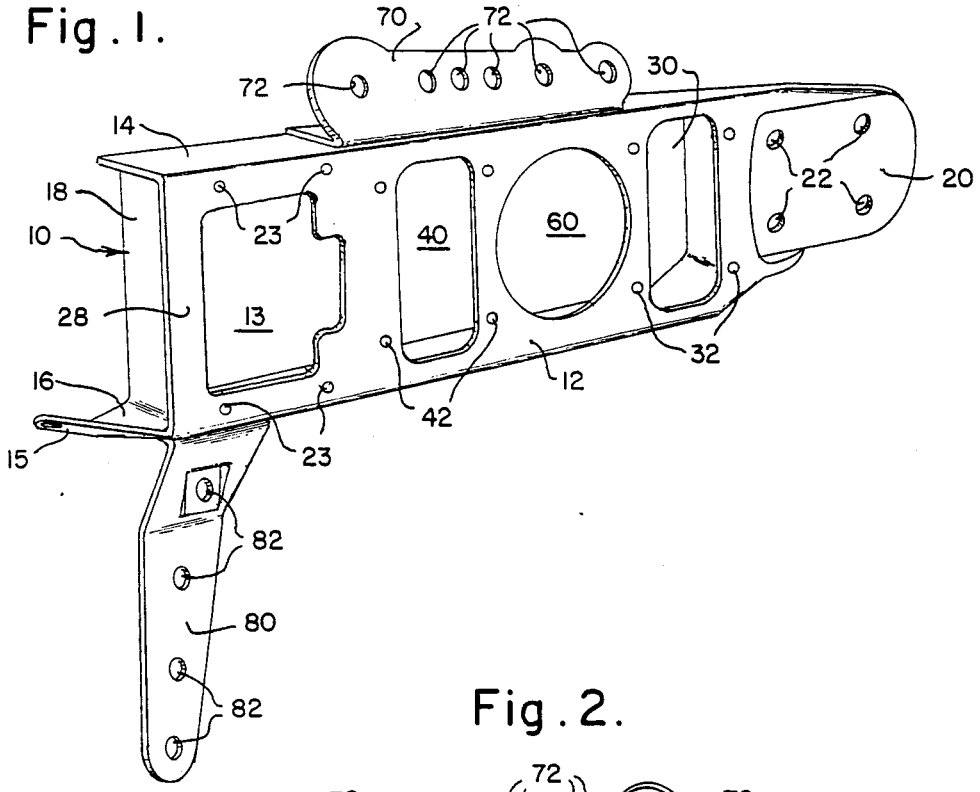
FIG. 1 is a perspective view of a present preferred chassis of the present invention.

Referring to the figures, the chassis 10 of the present invention is formed of metal and is preferably in the form of a U-shaped member having an upper surface portion 12 and a pair of depending side panels 14 and 16 extending from opposite sides of upper surface portion 12 and a pair of depending end panels 17 and 18 extending from the ends 20 and 28 respectively of chassis 10. A first end 20 of chassis 10 is adapted to receive a guitar neck. The neck 50 (FIG. 2) is bolted to the chassis through openings 22.

Figure 6:
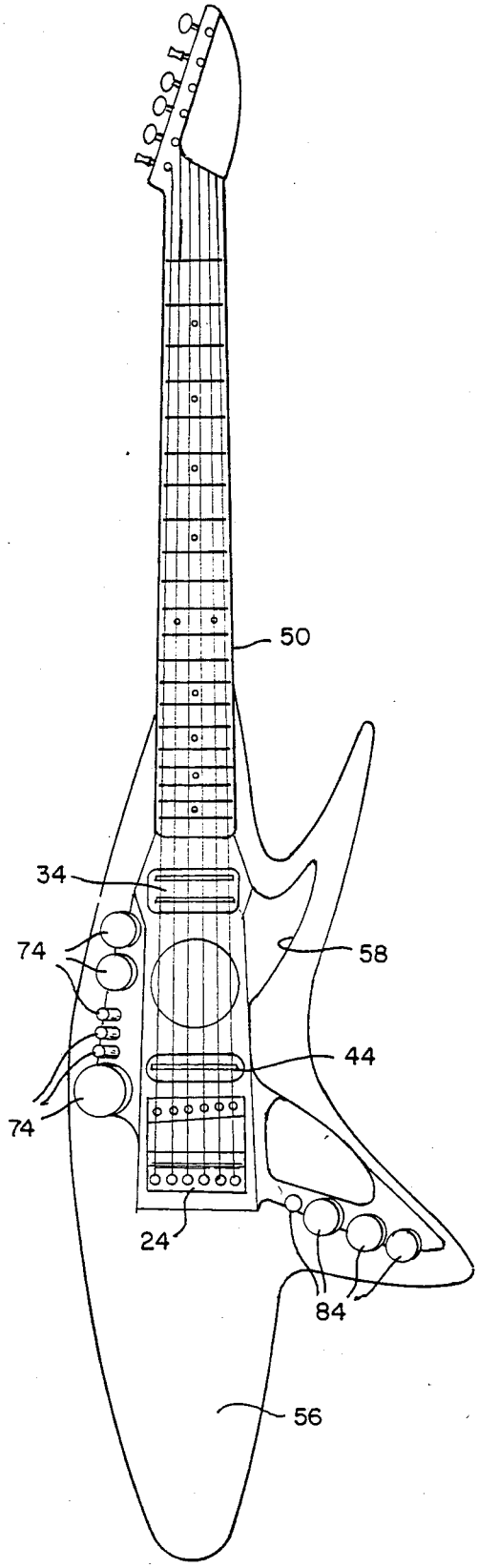
FIG. 6 is a top plan view of a guitar, including a body according to the present invention.

The upper surface 12 of chassis 10 also has an opening 13 in opposite end 28 thereof adapted to receive and secure a guitar bridge 24 (FIG. 6). The bridge 24 is bolted to the chassis through openings 23. As best shown in FIG. 1, upper surface 12 is also provided with a pair of openings 30 and 40 to which guitar pickups 34 and 44, respectively, are bolted through holes 32 and 42.

Chassis 10 has a pair of outwardly extending flanges 70 and 80 having openings 72 and 82, respectively, therein. Flanges 70 and 80 are utilized to mount various electronic components. Various control knobs and switches 74 and 84 are adapted to extend through holes 72 and 82.

Figure 2:
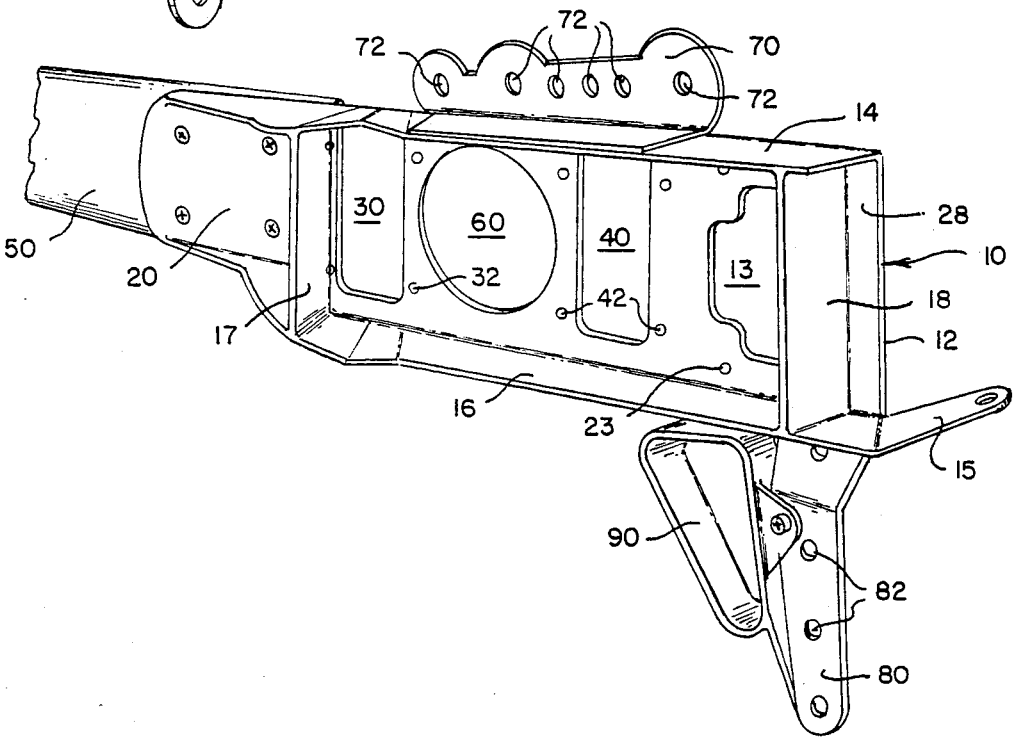
FIG. 2 is a bottom plan view of the chassis of FIG. 1 showing an attached neck and battery housing.

Referring to FIG. 2, a bottom plan view shows the mounting of neck 50 to end 20 of chassis 10. FIG. 2 also illustrates the provision of an optional battery housing 90 secured to the chassis. The battery in the housing may be utilized to energize the various electronic components within the guitar.

Figure 3:
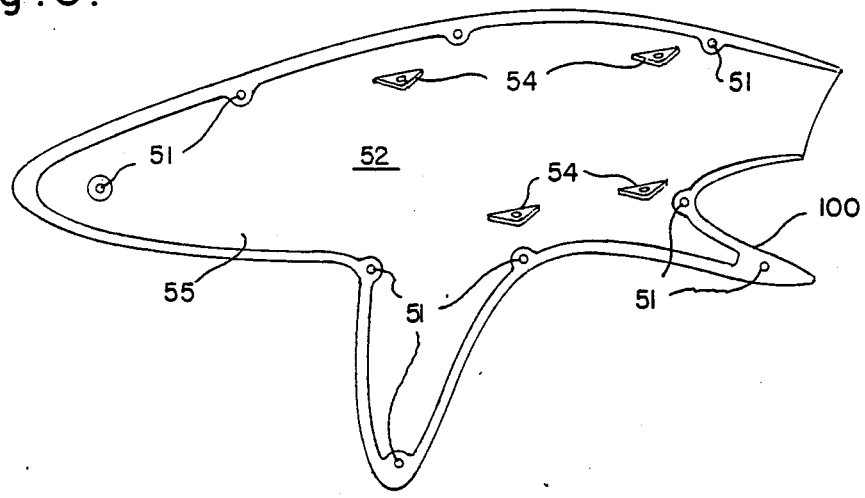
FIG. 3 is a top plan view of a lower portion of one outer shell of the present invention.
Figure 4:
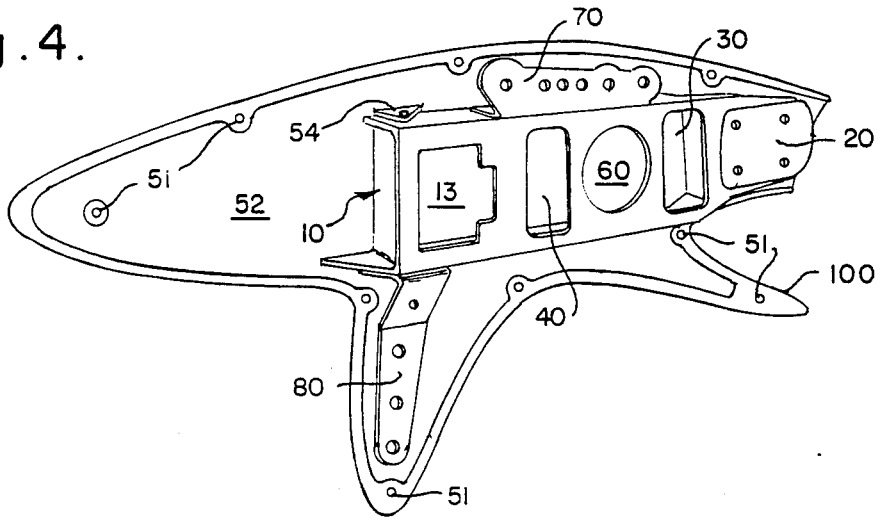
FIG. 4 is a perspective view showing the chassis as attached to the lower portion of the outer shell of FIG. 4.
Figure 5:
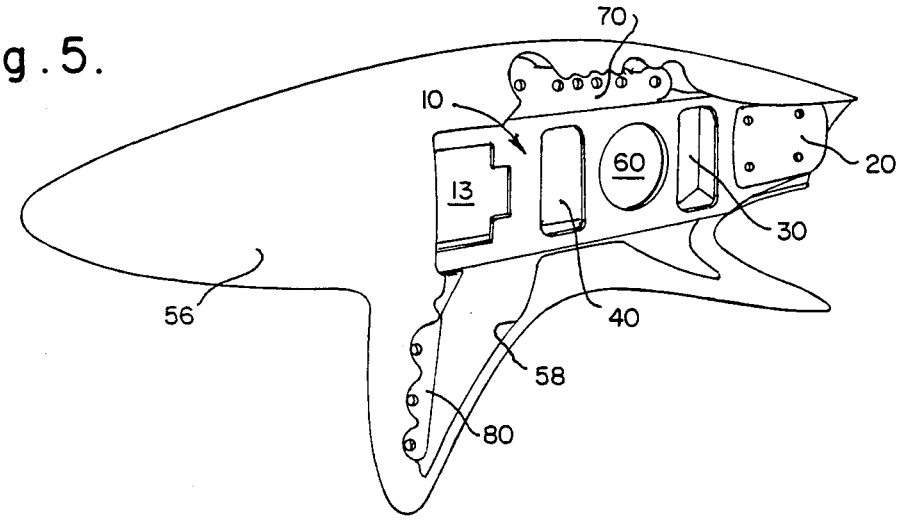
FIG. 5 is a top plan view showing the upper portion of the outer shell attached to the lower portion thereof.

FIG. 3 is a top plan view of the lower portion 52 of a presently preferred outer shell. The lower portion 52 of the outer shell preferably includes a plurality of upwardly extending ear portions 54 which are spaced and positioned to engage side panel portions 14 and 16 of chassis 10. The leg portions are bolted or otherwise attached to lower portion 100 of the outer shell. To provide an additional mounting means, one or more outwardly extending mounting flanges 15 (FIG. 2) may be provided along a lower edge of leg portions 14 and 16 to provide additional locations where the lower shell portion 100 may be secured to chassis 10.

An upper portion 56 of the outer shell is secured to the lower portion 50 by means of suitable screws which extend through openings 51 in lower portion 50 into the upper portion 56. Upper portion 50 is preferably provided with a large opening 58 through which the pickups 34, 44 and bridge 54 are exposed (FIG. 6).

As indicated above, the inner surface 55 of lower shell portion 50 and the inner surface (not shown) of upper shell portion 56 may be painted or otherwise coated with a suitable electrically conducting material. Alternatively, portions 50 and 56 may be formed from a plastic material including electrically conducting components.

FIG. 6 illustrates one form of an electric guitar including a body of the present invention. The guitar includes a conventional neck 59, pickups 34 and 44 and bridge 54, all of which are attached to chassis 10 as described above. Opening 58 in upper shell portion 56 exposes a plurality of control knobs and switches 74 and 84 as well as the pickups 34 and 44 and the bridge 54.

Figure 7:
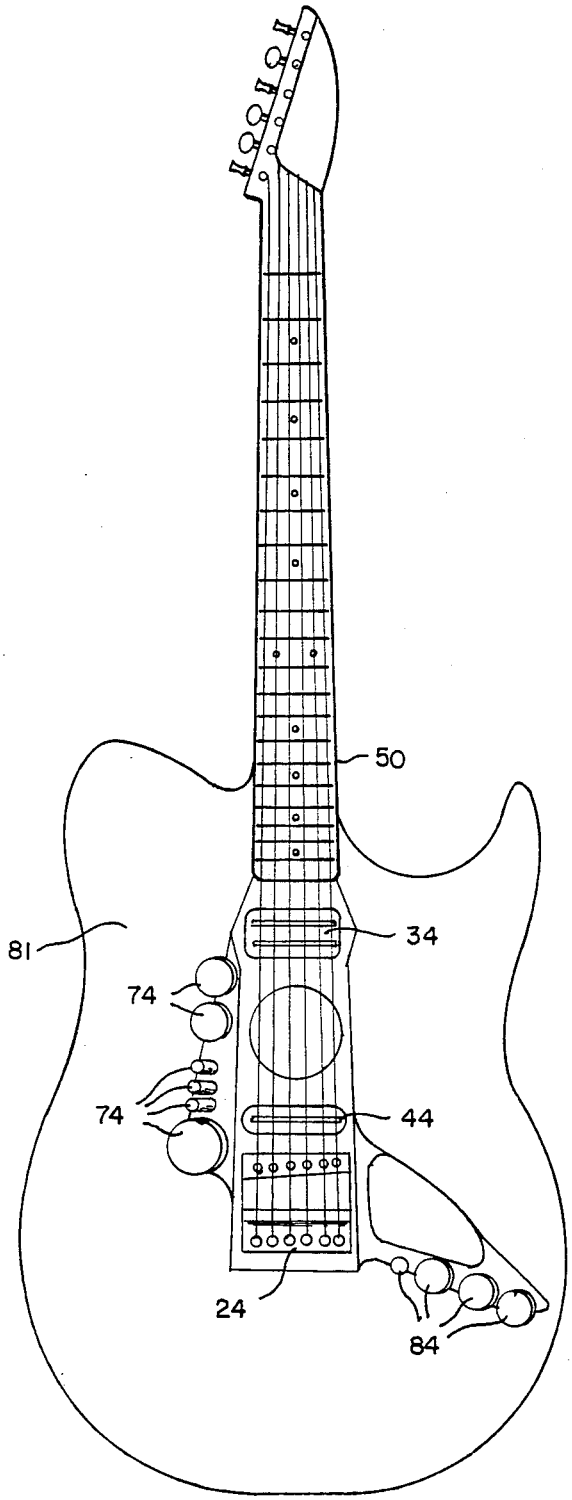
FIG. 7 is a top plan view showing a second preferred guitar embodiment having a different outer shell thereon.

Finally, FIG. 7 shows my chassis having a different outer shell 81 thereon. For this embodiment, the chassis of FIG. 1 is modified slightly so that the openings for guitar pickup and control knobs will align with holes in the outer shell 81. Nevertheless control knobs 74 and 84 as well as bridge 24 are in the same position relative to the chassis.

While I have described the presently preferred embodiment of my invention it is distinctly understood that the invention is not limited thereto and may be otherwise be variously practiced within the scope of the following claims.

I claim:

1. A body for an electronic stringed instrument comprising:

(a) a metal chassis of a fixed shape, having an upper surface having a first end adapted to receive and secure a neck of the stringed instrument and an opposite end adapted to receive and secure a bridge of the stringed instrument, two side panels and a pair of end panels attached to the upper surface, each end panel attached to the side panels, said end panels, side panels and upper surface defining an open box-like structure, said chassis having at least one opening in the upper surface thereof, (b) an outer body shell, said outer shell having a lower portion removably secured to said metal chassis and an upper portion removably secured to said lower portion, said outer shell creating a cavity into which various electronic components may be secured.

2. A body according to claim 1 wherein said chassis is in the form of a U-shaped member having an upper surface portion and a pair of spaced apart parallel side panels depending downwardly from opposite sides of said upper surface portion.

3. A body according to claim 2 wherein said lower portion of said outer shell has plural upwardly extending ear portions spaced and positioned to engage said side panels and to which said side panels are secured.

4. A body according to claim 1 wherein said chassis has a circular opening in an upper surface portion thereof positioned at a location over which strings of the instrument may be strummed.

5. A body for an electronic stringed instrument comprising a metal chassis having a first end adapted to receive and secure a neck of the stringed instrument and an opposite end adapted to receive and secure a bridge of the stringed instrument, said chassis having at least one opening in an upper surface thereof adapted to receive and secure an electric pickup and having at least one outwardly extending flange onto which various electronic components may be mounted, an outer body shell, said outer shell having a lower portion removably secured to said metal chassis and an upper portion removably secured to said lower portion, said outer shell creating a cavity into which various electronic components may be secured.

6. A body according to claim 5 wherein said flange has openings therein through which various control knobs and switches may extend.

7. A body according to claim 1 wherein said chassis supports an auxiliary battery housing.

8. A body according to claim 1 wherein said upper portion of said outer shell has an opening therein through which at least the pickup opening and a bridge opening are exposed.

9. A body according to claim 1 wherein the outer shell is formed from a plastic.

10. A body according to claim 1 wherein the outer shell is formed from a plastic material including electrically conducting components.

11. A body according to claim 1 wherein the outer shell has an inner surface coated with an electrically conducting material.

* * * * *

UNITED STATES PATENT AND TRADEMARK OFFICE

CERTIFICATE OF CORRECTION

PATENT NO. : 4,915,004

DATED : April 10, 1990

INVENTOR(S) : ERIC CLOUGH

It is certified that error appears in the above-identified patent and that said Letters Patent is hereby corrected as shown below:

Column 6, line 5, claim 2, delete "portion".

Signed and Sealed this

Sixteenth Day of February, 1993

*Attest:*

STEPHEN G. KUNIN

*Attesting Officer*

*Acting Commissioner of Patents and Trademarks*